US007332122B2

(12) United States Patent
Weinl et al.

(10) Patent No.: US 7,332,122 B2
(45) Date of Patent: Feb. 19, 2008

(54) TI(C,N)-(TI,NB,W)(C,N)-CO ALLOY FOR MILLING CUTTING TOOL APPLICATIONS

(75) Inventors: Gerold Weinl, Älvsjö (SE); Ulf Rolander, Stockholm (SE); Marco Zwinkels, Sundbyberg (SE)

(73) Assignee: Sandvik Intellectual Property AB, Sandviken (SE)

( * ) Notice: Subject to any disclaimer, the term of this patent is extended or adjusted under 35 U.S.C. 154(b) by 403 days.

(21) Appl. No.: 10/679,326

(22) Filed: Oct. 7, 2003

(65) Prior Publication Data

US 2004/0129111 A1 Jul. 8, 2004

(30) Foreign Application Priority Data

Nov. 19, 2002 (SE) ..... 0203408

(51) Int. Cl.
*C22C 1/05* (2006.01)
*C22C 32/00* (2006.01)

(52) U.S. Cl. ..... 419/14; 419/15; 419/16; 148/421; 75/238; 75/245; 420/427

(58) Field of Classification Search ..... None
See application file for complete search history.

(56) References Cited

U.S. PATENT DOCUMENTS 3,994,692 A 11/1976 Rudy
5,308,376 A 5/1994 Oskarsson
5,314,657 A 5/1994 Ostlund
5,370,719 A * 12/1994 Teruuchi et al. ..... 51/309
5,460,893 A * 10/1995 Teruuchi et al. ..... 428/552
5,518,822 A * 5/1996 Teruuchi et al. ..... 428/548
5,682,590 A * 10/1997 Weinl ..... 419/15
5,939,651 A * 8/1999 Isobe et al. ..... 75/236
6,004,371 A 12/1999 Rolander et al.
6,344,170 B1 2/2002 Rolander et al.

FOREIGN PATENT DOCUMENTS

EP 0 872 566 A1 10/1998
EP 1 052 297 A1 11/2000

(Continued)

OTHER PUBLICATIONS

P. Lindahl et al., Microstructure and Mechanical Properties of a (Ti, W, Ta, Mo)(C,N)-(Co, Ni)- Type Cermet, *J. Hard Mater.*, 4 pp. 187-204 (1993).

J. Zackrisson et al., Effect of Carbon Content on the Microstructure and Mechanical Properties of (Ti, W, Ta, Mo) (C, N)-(Co, Ni)

(Continued)

*Primary Examiner*—John P. Sheehan
(74) *Attorney, Agent, or Firm*—Drinker Biddle & Reath LLP

(57) ABSTRACT

A titanium based carbonitride alloy containing Ti, Nb, W, C, N and Co. The alloy also contains, in addition to Ti, 9-14 at % Co with only impurity levels of Ni and Fe, 1-<3 at % Nb, 3-8 at % W and has a C/(C+N) ratio of 0.50-0.75. The amount of undissolved Ti(C,N) cores should be kept between 26 and 37 vol % of the hard constituents, the balance being one or more complex carbonitrides containing Ti, Nb and W. The alloy is particularly useful for milling of steel.

8 Claims, 1 Drawing Sheet

FOREIGN PATENT DOCUMENTS

| | | |
|---|---|---|
| EP | 1052300 B1 | 3/2003 |
| EP | 1052297 B1 | 7/2003 |
| JP | 6-248385 | 9/1994 |

OTHER PUBLICATIONS

Cermets, *International Journal of Refractory Metals and Hard Materials*, vol. 17, 4, pp. 265-273 (Aug. 1999).

* cited by examiner

TI(C,N)-(TI,NB,W)(C,N)-CO ALLOY FOR MILLING CUTTING TOOL APPLICATIONS

This application claims priority under 35 U.S.C. § 119 to Swedish Application No. SE 0203408-0 filed in Sweden on Nov. 19, 2002; the entire contents of which is hereby incorporated by reference.

FIELD OF THE INVENTION

The present invention relates to a sintered carbonitride alloy with Ti as the main component and a cobalt binder phase, which has improved properties particularly when used as tool material for metal cutting, particularly in steel milling operations. More particularly, the present invention relates to a carbonitride-based hard phase of specific composition, for which the amount of undissolved Ti(C,N) cores is optimized for maximal abrasive wear resistance, while the Co and Nb contents are simultaneously optimized to give the desired toughness and resistance to plastic deformation.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Titanium-based carbonitride alloys, so called cermets, are widely used for metal cutting purposes. Compared to WC—Co based materials, cermets have excellent chemical stability when in contact with hot steel, even if the cermet is uncoated, but have substantially lower strength. This makes them most suited for finishing operations, which generally are characterized by limited mechanical loads on the cutting edge and a high surface finish requirement on the finished component.

Cermets comprise carbonitride hard constituents embedded in a metallic binder phase generally of Co and Ni. The hard constituent grains generally have a complex structure with a core, most often surrounded by one or more rims having a different composition. In addition to Ti, group VIA elements, normally both Mo and W, are added to facilitate wetting between binder and hard constituents and to strengthen the binder phase by means of solution hardening. Group IVA and/or VA elements, e.g.—Zr, Hf, V, Nb, and Ta, are also added in all commercial alloys available today. Cermets are produced using powder metallurgical methods. Powders forming binder phase and powders forming hard constituents are mixed, pressed and sintered. The carbonitride forming elements are added as simple or complex carbides, nitrides and/or carbonitrides. During sintering the hard constituents dissolve partly or completely in the liquid binder phase. Some, such as WC, dissolve easily whereas others, such as Ti(C,N), are more stable and may remain partly undissolved at the end of the sintering time. During cooling the dissolved components precipitate as a complex phase on undissolved hard phase particles or via nucleation in the binder phase forming the above-mentioned core-rim structure.

During recent years many attempts have been made to control the main properties of cermets in cutting tool applications, namely toughness, wear resistance and plastic deformation resistance. Much work has been done especially regarding the chemistry of the binder phase and/or the hard phase and the formation of the core-rim structures in the hard phase. Most often only one, or at the most, two of the three properties are able to be optimized at the same time, at the expense of the third one.

U.S. Pat. No. 5,308,376 discloses a cermet in which at least 80 vol % of the hard phase constituents comprises core-rim structured particles having several, preferably at least two, different hard constituent types with respect to the composition of core and/or rim(s). These individual hard constituent types each consist of 10-80%, preferably 20-70%, by volume of the total content of hard constituents.

JP-A-6-248385 discloses a Ti—Nb—W—C—N—cermet in which more than 1 vol % of the hard phase comprises coreless particles, regardless of the composition of those particles.

EP-A-872 566 discloses a cermet in which particles of different core-rim ratios coexist. When the structure of the titanium-based alloy is observed with a scanning electron microscope, particles forming the hard phase in the alloy have black core parts and peripheral parts which are located around the black core parts and appear gray. Some particles have black core parts occupying areas of at least 30% of the overall particles referred to as big cores and some have the black core parts occupying areas of less than 30% of the overall particle area are referred to as small cores. The amount of particles having big cores is 30-80% of total number of particles with cores.

U.S. Pat. No. 6,004,371 discloses a cermet comprising different microstructural components, namely cores which are remnants of and have a metal composition determined by the raw material powder, tungsten-rich cores formed during the sintering, outer rims with intermediate tungsten content formed during the sintering and a binder phase of a solid solution of at least titanium and tungsten in cobalt. Toughness and wear resistance are varied by adding WC, (Ti,W)C, and/or (Ti,W)(C,N) in varying amounts as raw materials.

U.S. Pat. No. 3,994,692 discloses cermet compositions with hard constituents consisting of Ti, W and Nb in a Co binder phase. The technological properties of these alloys as disclosed in the patent are not impressive.

A significant improvement compared to the above disclosures is presented in U.S. Pat. No. 6,344,170. By optimizing composition and sintering process in the Ti—Ta—W—C—N—Co system improved toughness and resistance to plastic deformation is accomplished. The two parameters that are used to optimize toughness and resistance to plastic deformation are the Ta and Co content. The use of pure Co-based binder is a major advantage over mixed Co—Ni-based binders with respect to the toughness behavior due to the differences in solution hardening between Co and Ni. There is, however, no teaching how to optimize abrasive wear resistance simultaneously with the other two performance parameters. Hence, the abrasive wear resistance is still not optimal, which is necessary most often especially in milling applications, where, on the other hand, resistance to plastic deformation normally is not as important as for turning applications.

SUMMARY OF THE INVENTION

It is an object of the present invention to solve the problem described above and others.

It is a further object to provide a cermet material with substantially improved wear resistance while maintaining toughness and resistance to plastic deformation on the same level as state-of-the-art cermets.

According to a first aspect, the present invention provides a titanium based carbonitride alloy comprising hard constituents with undissolved Ti(C,N) cores, the alloy further comprising 9-14 at % Co, 1-<3 at % Nb, 3-8 at % W, C and N having a C/(N+C) ratio of 0.50-0.75, and wherein the amount of undissolved Ti(C,N) cores is between 26 and 37 vol % of the hard constituents and the balance being one or more complex carbonitride phases.

According to a second aspect, the present invention provides a method of manufacturing a titanium-based carbonitride alloy comprising hard constituents with undissolved Ti(C,N) cores, the method comprising: mixing hard constituent powders of $TiC_xN_{1-x}$, x having a value of 0.46-0.70, NbC and WC with powder of Co, pressing into bodies of desired shape and sintered in a $N_2$—CO—Ar atmosphere at a temperature in the range 1370-1500° C. for 1.5-2 h in order to obtain the desired amount of undissolved Ti(C,N) cores, wherein the amount of Ti(C,N) powder is 50-70 wt-% of the powder mixture, its grain size is 1-3 μm and the sintering temperature and sintering time are chosen to give an amount of undissolved Ti(C,N) cores between 26 and 37 vol % of the hard constituents.

DETAILED DESCRIPTION OF THE INVENTION

Figure 1:
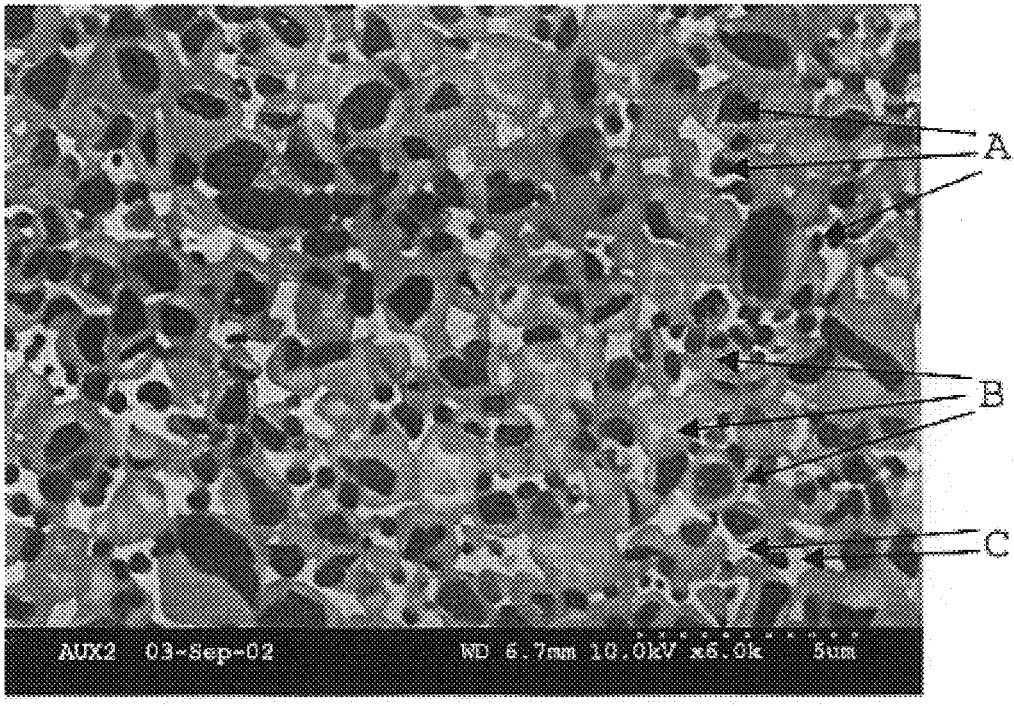
FIG. 1 is a scanning electron micrograph illustrating the microstructure of an alloy of the present invention.

It has been found possible to design and produce a material with substantially improved wear resistance while maintaining toughness and resistance to plastic deformation on the same level as state-of-the-art cermets. This has been achieved by working with the alloy system Ti—Nb—W—C—N—Co.

Within the system Ti—Nb—W—C—N—Co a set of constraints has been found rendering optimum properties for the intended application areas. More specifically, the abrasive wear resistance is maximized for a given level of toughness and resistance to plastic deformation by optimizing the amount of undissolved Ti(C,N) cores. The amount of undissolved Ti(C,N) cores can be varied independently from other parameters, such as Nb and binder content. Hence, it has been possible to simultaneously optimize all three main cutting performance criteria, i.e.—toughness, abrasive wear resistance and resistance to plastic deformation.

FIG. 1 shows the microstructure of an alloy according to the invention as observed in back scattering mode in a scanning electron microscope in which A depicts undissolved Ti(C,N)-cores; B depicts a complex carbonitride phase sometimes surrounding the A-cores, and C depicts the Co binder phase.

In one aspect, the present invention provides a titanium based carbonitride alloy particularly useful for milling operations. The alloy consists of Ti, Nb, W, C, N and Co. When observed in back scattering mode in a scanning electron microscope the structure consists of black cores of Ti(C,N), A, a gray complex carbonitride phase, B, sometimes surrounding the A-cores, and an almost white Co binder phase, C, as depicted in FIG. 1.

According to the present invention it has unexpectedly been found that the abrasive wear resistance can be maximized for a given level of toughness and resistance to plastic deformation by optimizing the amount of undissolved Ti(C,N)-cores (A). A large amount of undissolved cores is favorable for the abrasive wear resistance. However, the maximum amount of these cores is limited by the demand for sufficient toughness for a specific application since toughness decreases at high levels of undissolved cores. This amount should therefore be kept at 26 to 37 vol % of the hard constituents, preferably 27 to 35 vol %, most preferably 28 to 32 vol %, the balance being one or more complex carbonitride phases containing Ti, Nb and W.

The composition of the Ti(C,N)-cores can be more closely defined as $TiC_xN_{1-x}$. The C/(C+N) atomic ratio, x, in these cores should be 0.46-0.70, preferably 0.52-0.64, most preferably 0.55-0.61.

The overall C/(C+N) ratio in the sintered alloy should be 0.50-0.75.

The average grain size of the undissolved cores, A, should be 0.1-2 μm and the average grain size of the hard phase including the undissolved cores 0.5-3 μm.

The Nb and Co contents should be chosen properly to give the desired properties for the envisioned application area.

Milling applications place high demands on productivity and reliability, which translates to the need for high resistance to abrasive wear resistance and high toughness, yet with a sufficient resistance to plastic deformation. This combination is best achieved by Nb contents of 1.0 to <3.0 at %, preferably 1.5 to 2.5 at % and Co contents of 9 to 14 at %, preferably 10 to 13 at %. W is needed to get a sufficient wettability. The W content should be 3 to 8 at %, preferably less than 4 at %, to avoid an unacceptably high porosity level.

For some milling operations requiring even higher wear resistance it is advantageous to coat the body of the present invention with a thin wear resistant coating using PVD, CVD, MTCVD or similar techniques. It should be noted that the composition of the insert is such that any of the coatings and coating techniques used today for WC—Co based materials or cermets may be directly applied, though the choice of coating will also influence the deformation resistance and toughness of the material.

In another aspect of the invention, there is provided a method of manufacturing a sintered titanium-based carbonitride alloy. Hard constituent powders of $TiC_xN_{1-x}$, with x having a value of 0.46-0.70, preferably 0.52-0.64, most preferably 0.55-0.61, NbC and WC are mixed with powder of Co to a composition as defined above and pressed into bodies of desired shape. Sintering is performed in a $N_2$—CO—Ar atmosphere at a temperature of 1370-1500° C. for 1.5-2 h, preferably using the technique described in EP-A-1052297. In order to obtain the desired amount of undissolved Ti(C,N) cores the amount of Ti(C,N) powder shall be 50-70 wt-%, its grain size 1-3 μm and the sintering temperature and sintering time have to be chosen adequately.

The principles of the present invention will now be further described by reference to the following illustrative, non-limiting examples.

EXAMPLE 1

A powder mixture of nominal composition (at %) Ti 39.5%, W 3.7%, Nb 1.7%, Co 10.0% and a C/(N+C) ratio of 0.62 (Alloy A) was prepared by wet milling of:

62.0 wt-% $TiC_{0.58}N_{0.42}$ with a grain size of 1.43 μm;
4.7 wt-% NbC grain size 1.75 μm;
17.9 wt-% WC grain size 1.25 μm; and
15.4 wt-% Co.

The powder was spray dried and pressed into SEKN1203-EDR inserts. The inserts were dewaxed in $H_2$ and subsequently sintered in a $N_2$—CO—Ar atmosphere for 1.5 h at 1480° C., according to EP-A-1052297, which was followed by grinding and conventional edge treatment. Polished cross sections of inserts were prepared by standard metallographic techniques and characterized using scanning electron microscopy. FIG. 1 shows a scanning electron micrograph of such a cross section, taken in back scattering mode. As indicated in FIG. 1, the black particles (A) are the undissolved Ti(C,N) cores and the light gray areas (C) are the binder phase. The remaining gray particles (B) are the part of the hard phase consisting of carbonitrides containing Ti, Nb and W. Using image analysis, the amount of undissolved Ti(C,N) cores, A, was determined to be 31.3 vol % of the hard constituents.

EXAMPLE 2 (COMPARATIVE)

Inserts in a commercially well-established cermet milling grade (Alloy B) were manufactured according to U.S. Pat. No. 5,314,657.

The composition of Alloy B is (at %) Ti 34.2%, W 4.1%, Ta 2.5%, Mo 2.0%, Nb 0.8%, Co 8.2%, Ni 4.2% with a C/(N+C) ratio of 0.63.

Characterization was carried out in the same manner as described in Example 1. Using image analysis, the amount of undissolved Ti(C,N) cores was determined to be 20.3 vol % of the hard constituents.

EXAMPLE 3

SEKN 1203 inserts from the two titanium-based alloys of Examples 1 and 2 were tested in milling operations. Toughness tests were performed by using single tooth end milling over a rod made of SS2541 with a diameter of 80 mm. The cutter body with a diameter of 250 mm was centrally positioned in relation to the rod. The cutting parameters used were cutting speed 130 m/min and depth of cut 2.0 mm. No coolant was used. The feed corresponding to 50% fracture after testing 10 inserts per variant was 0.38 mm/rev for alloy A according to the invention and 0.35 mm/rev for the alloy B.

EXAMPLE 4

SPKN 1203 inserts from the two titanium-based alloys of Examples 1 and 2 were tested in milling operations. Tool life was determined with criterion of flank wear, $V_b$ exceeding 0.3 mm. The test material was steel SS1672 and the cutting conditions were the following:

Single tooth dry milling along a rectangular shaped workpiece with a width of 48 mm and length 600 mm, depth of cut 1.0 mm, feed 0.10 mm/rev and cutting speed 400 m/min.

A cutter body with a diameter of 80 mm was centrally positioned in relation to the workpiece. Three edges of each alloy were tested. Tool life criterion was $V_b$>0.3 mm. The milled length, in mm, for each edge is shown in the table below.

| | Edge number | | |
|---|---|---|---|
| | 1 | 2 | 3 |
| Alloy A | 13200 | 15000 | 13800 |
| Alloy B | 12000 | 12600 | 10800 |

When summarizing the results in Examples 3-4, it is obvious that the alloy according to the invention has obtained an improved overall cutting behavior compared to the comparative alloy.

The described embodiments of the present invention are intended to be illustrative rather than restrictive, and are not intended to represent every possible embodiment of the present invention. Various modifications can be made to the disclosed embodiments without departing from the spirit or scope of the invention as set forth in the following claims, both literally and in equivalents recognized in law.

We claim:

1. A titanium based carbonitride alloy consisting of:

9-14 at % Co;

1-<3 at % Nb;

3-8 at % W;

C and N having a C/(N+C) ratio of 0.50-0.75;

hard constituents with undissolved Ti(C,N) cores, wherein the amount of undissolved Ti(C,N) cores is between 26 and 37 vol % of the hard constituents and the balance being one or more complex carbonitride phases; and balance Ti.

2. The alloy according to claim 1, wherein the alloy contains 10-13 at % Co.

3. The alloy according to claim 1, wherein the alloy contains 1.5-2.5 at % Nb.

4. The alloy according to claim 1, wherein the alloy contains 3-4 at % W.

5. The alloy according to claim 1, wherein the amount of undissolved Ti(C,N) cores is between 27 and 35 vol % of the hard constituents.

6. The alloy according to claim 1, wherein the Ti(C,N) cores contain $TiC_xN_{1-x}$ and a C/(C+N) ratio in the Ti(C,N) cores is 0.46-0.70.

7. A method of manufacturing a titanium-based carbonitride alloy consisting of 9-14 at % Co, 1-<3 at % Nb, 3-8 at % W, C and N having a C/(N+C) ratio of 0.50-0.75, hard constituents with undissolved Ti(C,N) cores and balance Ti, the method comprising: mixing hard constituent powders of $TiC_xNi_{1-x}$, x having a value of 0.46-0.70, NbC and WC with powder of Co, pressing into bodies of desired shape and sintering in a $N_2$—CO—Ar atmosphere at a temperature in the range 1370-1500° C. for 1.5-2 h in order to obtain the desired amount of undissolved Ti(C,N) cores, wherein the amount of Ti(C,N) powder is 50-70 wt-% of the powder mixture, the Ti(C,N) powder has a grain size of 1-3 μm and the sintering temperature and sintering time are chosen to give the titanium-based carbon itride alloy an amount of undissolved Ti(C,N) cores between 26 and 37 vol % of the hard constituents with the balance of the hard constituents being one or more complex carbonitride phases.

8. The method according to claim 7, wherein the amount of undissolved Ti(C,N) cores is between 27 and 35 vol % of the hard constituents.

* * * * *